United States Patent [19]

Nakamura et al.

[11] Patent Number: 4,493,804

[45] Date of Patent: Jan. 15, 1985

[54] VARIABLE VENTURI-TYPE CARBURETOR

[75] Inventors: Norihiko Nakamura; Takaaki Itoh; Takashi Katou, all of Mishima; Yozo Ota, Chiryu; Toshiharu Morino, Mie, all of Japan

[73] Assignees: Toyota Jidosha Kabushiki Kaisha; Aisan Industry Co., Ltd., both of Japan

[21] Appl. No.: 617,844

[22] Filed: Jun. 7, 1984

Related U.S. Application Data

[63] Continuation of Ser. No. 404,831, Aug. 3, 1982, abandoned.

[30] Foreign Application Priority Data

Dec. 31, 1981 [JP] Japan ..... 56-209790

[51] Int. Cl.[3] ..... F02M 9/06

[52] U.S. Cl. ..... 261/44 C

[58] Field of Search ..... 261/44 C, 44 B

[56] References Cited

U.S. PATENT DOCUMENTS 2,062,496 12/1936 Brokel ..... 261/44 B
4,185,054 1/1980 Nakamura et al. ..... 261/44 C
4,264,537 4/1981 Watanabe et al. ..... 261/44 C
4,272,460 6/1981 Watanabe et al. ..... 261/44 C
4,302,404 11/1981 Nakamura et al. ..... 261/44 C
4,305,893 12/1981 Morino ..... 261/44 C
4,371,478 2/1983 Wada ..... 261/44 C

FOREIGN PATENT DOCUMENTS 972281 1/1951 France ..... 261/44 B

*Primary Examiner*—Tim Miles
*Attorney, Agent, or Firm*—Finnegan, Henderson, Farabow, Garrett & Dunner

[57] ABSTRACT

A variable venturi-type carburetor comprising a suction piston which has a tip face. A raised wall is formed on the inner wall of the intake passage, which faces the tip face of the suction piston. The raised wall has a substantially straight extending tip edge. The inner wall of the intake passage and the tip edge of the raised wall define a D-shaped air inlet mouth. The connecting portions of the inner wall of the intake passage and the tip edge of the raised wall have an arc shape. The upstream end portion of the tip face of the suction piston and the tip edge of the raised wall define an isosceles triangular air inlet opening therebetween when the amount of air fed into the cylinder of the engine is small.

6 Claims, 7 Drawing Figures

VARIABLE VENTURI-TYPE CARBURETOR

This application is a continuation of application Ser. No. 06/404,831, filed Aug. 3, 1982, now abandoned.

BACKGROUND OF THE INVENTION

The present invention relates to a variable venturi-type carburetor.

The inventor has proposed a variable venturi-type carburetor having a raised wall which projects from the inner wall of the intake passage, which inner wall faces the tip face of the suction piston serving to change the cross-sectional area of the venturi portion of the carburetor in response to a change in the amount of air fed into the cylinder of the engine. In this carburetor, a D-shaped air inflow mouth is formed between the substantially straight extending tip edge of the raised wall and the substantially circular cross-section inner wall of the intake passage, and at least the upstream end portion of the tip face of the suction piston is shaped in a V-shaped cross-section which expands toward the venturi portion so that an approximately triangular-shaped air inflow opening is formed between the tip edge of the raised wall and the upstream end portion of the tip face of the suction piston when the amount of air fed into the cylinder of the engine is small. In this carburetor, as mentioned above, the air inflow opening has an approximately triangular shape when the amount of air fed into the cylinder of the engine is small, so that the opening area of the air inflow opening is as proportional to the lift of the suction piston as possible in order to obtain the smooth movement of the suction piston when the amount of air fed into the cylinder of the engine is increased. However, in this carburetor, since the air inlet mouth is so formed that the substantially straight extending tip edge of the raised wall intersects with the substantially circular-shaped inner wall of the intake passage so as to form a sharp corner therebetween, when the upstream end portion of the tip face of the suction piston passes the sharp corner, the area of the air inflow opening abruptly changes and, as a result, a problem occurs in that the amount of fuel fed into the cylinder of the engine will abruptly change.

SUMMARY OF THE INVENTION

An object of the present invention is to provide a variable venturi-type carburetor capable of preventing the lift of the suction piston from abruptly changing when the amount of air fed into the cylinder of the engine is slightly changed independently of the position of the suction piston.

According to the present invention, there is provided a variable venturi-type carburetor comprising: an axially-extending intake passage formed in the carburetor and having an inner wall of an approximately circular cross-section; a suction piston transversely movable in said intake passage in response to a change in the amount of air flowing within said intake passage, said suction piston having a tip face which defines a venturi portion in said intake passage and has an upstream end portion; and a raised wall projecting from the inner wall of said intake passage, which faces the tip face of said suction piston, and having a substantially straight tip edge which has opposite ends intersecting the inner wall of said intake passage for defining an approximately D-shaped air inlet mouth between the tip edge of said raised wall and the inner wall of said intake passage, the intersecting portions of the tip edge of said raised wall and the inner wall of said intake passage having an arc shape, the upstream end portion of the tip face of said suction piston having an approximately V-shaped cross-section which expands toward said venturi portion for defining an approximately isosceles triangular air inlet opening between the upstream end portion of the tip face of said suction piston and the tip edge of said raised wall when the amount of air flowing within said intake passage is small.

The present invention may be more fully understood from the description of a preferred embodiment of the invention set forth below, together with the accompanying drawings.

DESCRIPTION OF A PREFERRED EMBODIMENT

Figure 1:
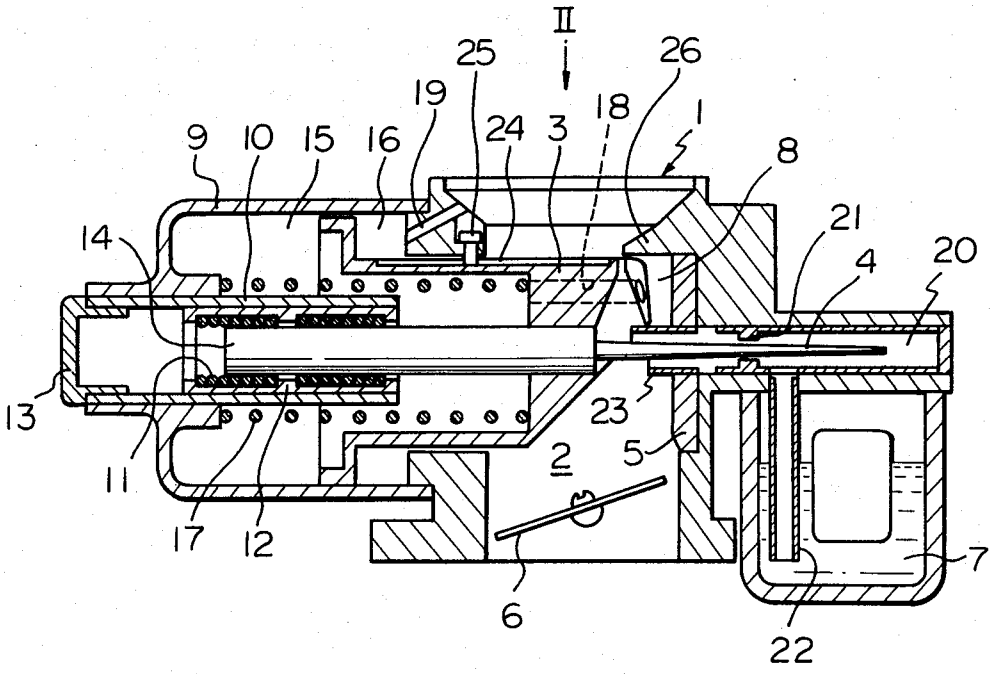
FIG. 1 is a cross-sectional side view of a variable venturi-type carburetor according to the present invention.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3; 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. On the other hand, a guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atmospheric pressure chamber 16 by the suction piston 3, and a compression spring 17 for continuously biasing the suction piston 3 toward the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

On the other hand, a fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi portion 8 and, in addition, the upper half of the tip portion of the nozzle 23 projects from the lower half of the tip portion of the nozzle 23 toward the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21. In addition, a groove 24, extending in the axial direction of the suction piston 3, is formed on the top face of the outer circumferential wall of the suction piston 3, and a screw 25, which is in engagement with the groove 24, is screwed into and fixed onto the carburetor body 1. The screw 25 and the groove 24 serve to prevent the suction piston 3 from rotating.

A raised wall 26, projecting horizontally into the intake passage 2, is formed at the upper end of the spacer 5. A flow control is effected between the raised wall 26 and the tip end portion of the suction piston 3. When the engine is started, air flows downward within the intake passage 2. At this time, since the air flow is restricted between the suction piston 3 and the raised wall 26, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

Referring to FIGS. 3 through 6, the entire tip face portion A of the suction piston 3, which is located upstream of the needle 4, projects from a needle-mounting face 27 toward the tip of the needle 4. The tip face portion B of the suction piston 3, which is located downstream of the needle 4, is inclined from the needle-mounting face 27 toward the vacuum chamber 15. Consequently, the tip face portion B forms an inclined surface directed downward. As will be understood from FIGS. 5 and 6, the tip face portions A and B of the suction piston 3 have a symmetrical shape relative to a symmetrical plane a passing through the axis of the intake passage 2, and a groove 28, extending along the symmetrical plane a, is formed on the tip face portion A of the suction piston 3. The upstream end portion **28*a* of the groove 28 has a U-shaped cross-section and is located at a position near the tip of the needle 4 relative to the needle-mounting face 27. The remaining portion 28*b* of the groove 28 extends substantially straight from the upstream end portion 28*a* to the needle-mounting face 27. In addition, the tip face portion A of the suction piston 3 has a V-shaped cross-section which expands from the groove 28 toward the venturi portion 8 and, therefore, the tip face portion A of the suction piston 3 has a pair of inclined wall portions 29*a* and 29*b* each being inclined toward the groove 28**.

Figure 2:
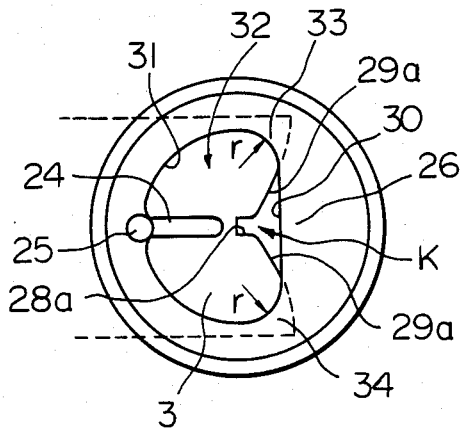
FIG. 2 is a plan view taken along the arrow II in FIG. 1.
Figure 3:
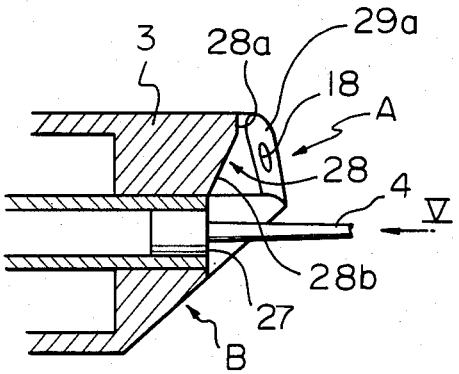
FIG. 3 is a cross-sectional side view of a portion of the suction piston illustrated in FIG. 1.
Figure 4:
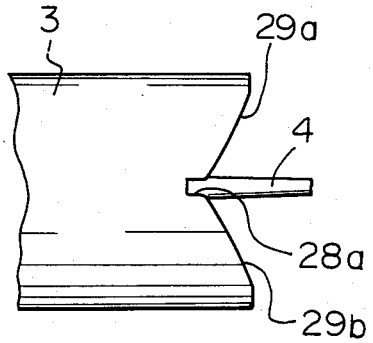
FIG. 4 is a plan view of FIG. 3.
Figure 5:
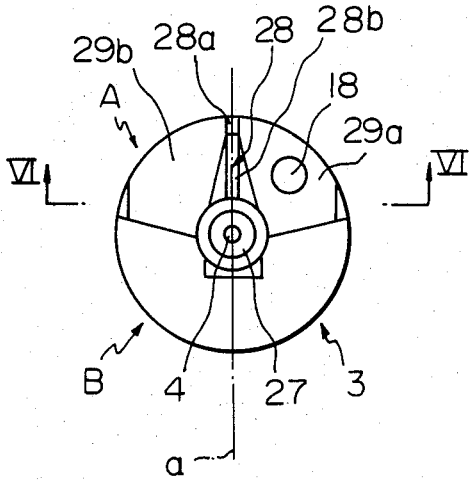
FIG. 5 is a front view of the tip face of the suction piston taken along the arrow V in FIG. 3.
Figure 6:
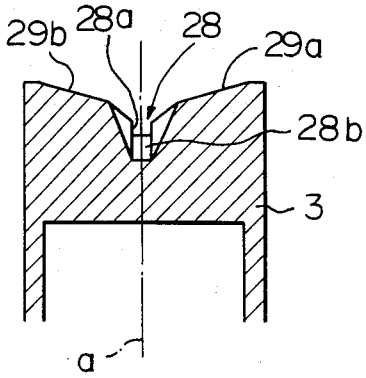
FIG. 6 is a cross-sectional view taken along the line VI—VI in FIG. 5.

As will be understood from FIG. 2, the tip edge 30 of the raised wall 26 extends substantially straight, and an approximately D-shaped air inflow mouth 32 is formed by the tip edge 30 of the raised wall 26 and the approximately circular cross-section inner wall 31 of the intake passage 2. In addition, the tip edge 30 of the raised wall 26 intersects with the inner wall 31 of the intake passage 2 at positions designated by reference numerals 33, 34. The intersecting portions 33, 34 of the tip edge 30 and the inner wall 31 have an arc shape having a radius r. As illustrated in FIG. 2, when the amount of air fed into the cylinder of the engine is small, an air inflow opening K is defined by the tip edge 30 of the raised wall 26, the inclined wall portions **29*a*, 29*b*, and the upstream end portion 28*a* of the groove 28**. Thus, at this time, the air inflow opening K has an approximately isosceles triangular shape.

Figure 7:
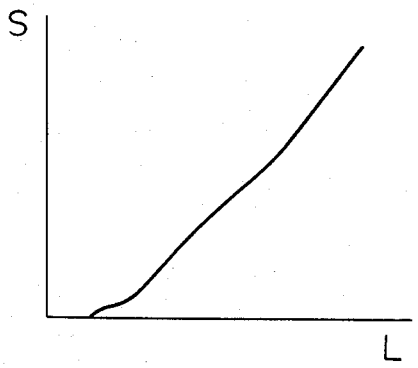
FIG. 7 is a diagram illustrating the relationship between the area of the air inflow opening and the lift of the suction piston.

FIG. 7 illustrates the relationship between the area of the air inflow opening K and the lift of the suction piston 3. In FIG. 7, the ordinate S indicates the area of the air inflow opening K, and the abscissa L indicates the lift of the suction piston 3. From FIG. 7, it will be understood that by forming the suction piston 3 and the raised wall 26 so that the air inflow opening K has an approximately isosceles triangular shape when the amount of air fed into the cylinder of the engine is small and by forming the tip edge 30 of the raised wall 26 and the inner wall 31 of the intake passage 2 so that the intersecting portions 33, 34 of the tip edge 30 and the inner wall 31 have an arc shape, the area S of the air inflow opening K, that is, the amount of air fed into the cylinder of the engine, is approximately proportional to the lift L of the suction piston 3. Consequently, the lift of the suction piston 3 is prevented from abruptly changing when the amount of air fed into the cylinder of the engine is slightly changed.

According to the present invention, since the lift of the suction piston does not abruptly change when the amount of air fed into the cylinder of the engine is slightly changed, the amount of fuel fed into the cylinder of the engine does not abruptly change and, as a result, it is possible to prevent the air-fuel ratio of mixture from fluctuating.

While the invention has been described with reference to a specific embodiment chosen for purposes of illustration, it should be apparent that numerous modifications could be made thereto by those skilled in the art without departing from the basic concept and scope of the invention.

We claim:

1. A variable venturi-type carburetor comprising:

an axially-extending intake passage formed in the carburetor and having an inner wall of an approximately circular cross section;

a suction piston transversely moveable in said intake passage from one side to another side thereof in response to a change in the amount of air flowing within said intake passage, said suction piston having a tip face which defines a venturi portion in said intake passage and has an upstream end portion; and a raised wall projecting from said another side of said intake passage immediately upstream of the upstream end portion of said suction piston, said raised wall having a substantially straight tip edge arcuately merging at the opposite ends thereof with the inner wall of said intake passage for defining an approximately D-shaped air inlet mouth of said intake passage upstream of said suction piston, the upstream end portion of the tip face of said suction piston having an approximately V-shaped cross section which expands toward said venturi portion, the straight tip edge and arcuate merging ends of said raised wall cooperating with the V-shaped upstream end to define an approximately isosceles triangular air inlet opening, said inlet opening gradually reducing in area as the suction piston approaches said another side when the amount of air flowing within said intake passage is reduced.

2. A variable venturi-type carburetor according to claim 1, wherein the tip face of said suction piston has a groove which opens to said intake passage upstream of said suction piston at the upstream end portion of the tip face of said suction piston, the V-shaped cross-section of said upstream end portion expanding from said groove toward said venturi portion.

3. A variable venturi-type carburetor according to claim 2, wherein said groove extends along the axis of said intake passage.

4. A variable venturi-type carburetor according to claim 2, wherein the tip face of said suction piston has a needle-mounting face on which a needle is mounted, said groove extending from the upstream end portion of the tip face of said suction piston to said needle-mounting face.

5. A variable venturi-type carburetor according to claim 2, wherein the tip face of said suction piston has a pair of inclined wall portions arranged on each side of said groove and extending to the upstream end portion of the tip face of said suction piston.

6. In a variable venturi carburetor having an axially-extending intake passage of substantially circular cross section and a suction piston moveable transverse said intake passage in response to changes in air flow through said intake passage, said suction piston having a tip face defining a venturi portion in said intake passage, a portion of said tip face having a substantially V-shaped cross section expanding towards said venturi portion, the improvement comprising:

a raised wall portion projecting from the inner wall of said intake passage immediately upstream of said suction piston opposite said tip face and having a substantially straight tip edge the opposite ends of which smoothly, arcuately merge with the inside wall of said intake passage forming a substantially D-shaped inlet mouth upstream of said suction piston, the V-shaped portion of said tip face cooperating with the tip edge and arcuately merging ends of said raised wall to define an approximately isosceles triangular air inlet, said air inlet gradually reducing in area as the suction piston moves towards said venturi portion.

* * * * *